US011560731B2

(12) United States Patent
Barber

(10) Patent No.: US 11,560,731 B2
(45) Date of Patent: Jan. 24, 2023

(54) VERTICAL FLOOD ESCAPE STRUCTURE

(71) Applicant: The Government of the United States of America, as represented by the Secretary of Homeland Security, Washington, DC (US)

(72) Inventor: Jeffrey B. Barber, Vineland, NJ (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

(21) Appl. No.: 17/731,084

(22) Filed: Apr. 27, 2022

(65) Prior Publication Data

US 2022/0349201 A1 Nov. 3, 2022

Related U.S. Application Data

(60) Provisional application No. 63/182,412, filed on Apr. 30, 2021.

(51) Int. Cl.

| | |
|---|---|
| ***E04H 9/14*** | (2006.01) |
| ***E04B 7/16*** | (2006.01) |
| ***E01F 3/00*** | (2006.01) |
| ***E02D 27/12*** | (2006.01) |
| ***E04H 12/00*** | (2006.01) |

(Continued)

(52) U.S. Cl.

CPC ..... *E04H 9/145* (2013.01); *E04B 7/163* (2013.01); *E04H 12/00* (2013.01); *E01F 3/00* (2013.01); *E02D 27/12* (2013.01); *E04F 11/032* (2013.01); *G08B 21/10* (2013.01)

(58) Field of Classification Search

CPC ..... E04H 9/14; E04H 9/145; E04B 7/163; E02D 27/12; B63C 2009/044; E01F 3/00

See application file for complete search history.

(56) References Cited

U.S. PATENT DOCUMENTS 4,269,384 A * 5/1981 Saeed ..... E04B 1/34326 248/548
5,117,594 A * 6/1992 Muramoto ..... E04B 1/3448 52/6

(Continued)

FOREIGN PATENT DOCUMENTS

FR 2916218 A1 * 11/2008 ..... E04B 1/3211
JP 6322839 B2 5/2018

(Continued)

*Primary Examiner* — Christine T Cajilig

(74) *Attorney, Agent, or Firm* — Lavanya Ratnam; Robert W. Busby; Kelly G. Hyndman

(57) ABSTRACT

A vertical escape structure comprises an escape housing disposed in a vertical orientation and mounted to a ground to maintain structural integrity in the vertical orientation against external flooding. The escape housing includes an interior which is sealed against water entry from exterior flooding and at least one of a staircase, a ladder, an elevator, or a lift disposed in the interior of the escape housing. The vertical escape structure further comprises a connecting walkway to connect the escape housing to a building. The escape housing has a smaller horizontal footprint than the building. The walkway is severable from the building by force without damaging the escape housing to cause water entry from the exterior flooding.

30 Claims, 5 Drawing Sheets

(A)

(B)

(51) Int. Cl.
*G08B 21/10* (2006.01)
*E04F 11/032* (2006.01)

(56) References Cited

U.S. PATENT DOCUMENTS

| | | | | |
|---|---|---|---|---|
| 5,377,778 | A * | 1/1995 | Lan | A62B 1/20 182/100 |
| 8,408,957 | B2 * | 4/2013 | Thomas | B63C 9/04 441/38 |
| 2010/0192480 | A1 * | 8/2010 | DeRose | E04H 9/14 52/173.1 |
| 2013/0205691 | A1 * | 8/2013 | Shalev | F28F 1/00 52/741.12 |
| 2018/0211506 | A1 * | 7/2018 | Green | E04H 9/14 |

FOREIGN PATENT DOCUMENTS

| | | | | |
|---|---|---|---|---|
| WO | WO-2012001610 | A2 * | 1/2012 | E02D 29/00 |
| WO | WO-2013018872 | A1 * | 2/2013 | B63C 11/52 |
| WO | WO-2013059890 | A1 * | 5/2013 | B63C 9/06 |
| WO | WO-2017061108 | A1 * | 4/2017 | E04H 9/14 |
| WO | WO-2019230585 | A1 * | 12/2019 | |

* cited by examiner (B)

(A)

VERTICAL FLOOD ESCAPE STRUCTURE

CROSS-REFERENCE TO RELATED APPLICATIONS

The application claims the benefit of priority from and is a non-provisional of U.S. Provisional Patent Application No. 63/182,412, filed on Apr. 30, 2021, entitled VERTICAL FLOOD ESCAPE STRUCTURES, the disclosure of which is incorporated by reference in its entirety.

STATEMENT OF GOVERNMENT INTEREST

The present invention was made by employees of the United States Department of Homeland Security in the performance of their official duties. The U.S. Government has certain rights in this invention.

FIELD

The discussion below relates generally to escape structures and, more particularly, to a vertical escape structure to provide evacuation refuge from flood events of the like.

BACKGROUND

Conventional storm, flood, or tsunami shelters are generally deployed away from the population because they are architecturally incompatible with residential neighborhoods. The lack of a sufficient number of these shelters that are in close proximity to the population prevents the effective use of conventional shelters to save lives and reduce injuries.

SUMMARY

Embodiments of the present invention are directed to apparatuses and methods for providing a vertical escape structure as an evacuation refuge from natural disasters including flood events such as tsunamis. Unlike a large, centralized structure, a plurality of these vertical flood escape structures are smaller, more aesthetically pleasing, and designed to blend in with the local environment. Unlike the large, centralized structure, such smaller structures may be dispersed throughout an area around a city or in a residential location, closer to its residents for easier access by more residents. The structure may be deployed for a single family/household, for example, to provide an evacuation refuge for occupants of a corresponding or associated residence or other building. The structure may have a tree appearance that blends in with the local trees (e.g., evergreen in the Midwest, palm tree in coastal regions, etc.). Due to their size and appearance, these escape structures can be distributed anywhere floods are anticipated (including inland locations) and are not limited to a single central deployment in only tsunami-prone locations (coastal areas).

According to an aspect of the present invention, a vertical escape structure comprises an escape housing disposed in a vertical orientation and mounted to a ground to maintain structural integrity in the vertical orientation against external flooding. The escape housing includes an interior which is sealed against water entry from exterior flooding and at least one of a staircase, an elevator, or a lift disposed in the interior of the escape housing. The vertical escape structure further comprises a connecting walkway to connect the escape housing to a building. The escape housing has a smaller horizontal footprint than the building. The walkway is severable from the building by force without damaging the escape housing to cause water entry from the exterior flooding.

According to another aspect of the invention, a method of providing escape from flooding comprises: mounting an escape housing in a vertical orientation to a ground to maintain structural integrity in the vertical orientation against external flooding; sealing an interior of the escape housing against water entry from exterior flooding; providing at least one of a staircase, an elevator, or a lift in the interior of the escape housing; and connecting a connecting walkway between the escape housing and a building. The escape housing has a smaller horizontal footprint than the building. The walkway is severable from the building by force without damaging the escape housing to cause water entry from the external flooding.

According to another aspect, a vertical escape structure comprises an escape housing disposed in a vertical orientation and mounted to a ground to maintain structural integrity in the vertical orientation against external flooding. The escape housing includes an interior which is sealed against water entry from exterior flooding and at least one of a staircase, an elevator, or a lift disposed in the interior of the escape housing. The vertical escape structure further comprises a mechanism or means for connecting a walkway between the escape housing and a building to render the walkway severable from the building by force without damaging the escape housing to cause water entry from the external flooding. The escape housing has a smaller horizontal footprint than the building.

According to yet another aspect, a vertical escape structure comprises an escape housing disposed in a vertical orientation and mounted to a ground to maintain structural integrity in the vertical orientation against external flooding. The escape housing includes an interior which is sealed against water entry from exterior flooding and at least one of a staircase, a ladder, an elevator, or a lift disposed in the interior of the escape housing. The escape housing includes a plurality of vertically stacked modules and a retractable roof.

Other features and aspects of various embodiments will become apparent to those of ordinary skill in the art from the following detailed description which discloses, in conjunction with the accompanying drawings, examples that explain features in accordance with embodiments. This summary is not intended to identify key or essential features, nor is it intended to limit the scope of the invention, which is defined solely by the claims.

BRIEF DESCRIPTION OF THE DRAWINGS

The attached drawings disclose the embodiments.

DETAILED DESCRIPTION

A number of examples or embodiments of the present invention are described and disclosed herein. The present invention provides many applicable inventive concepts that have been disclosed and can be embodied in a variety of ways. Rather, as will be appreciated by one of skill in the art, the teachings and disclosures herein can be combined or rearranged with other portions of this disclosure along with the knowledge of one of ordinary skill in the art.

Figure 1:
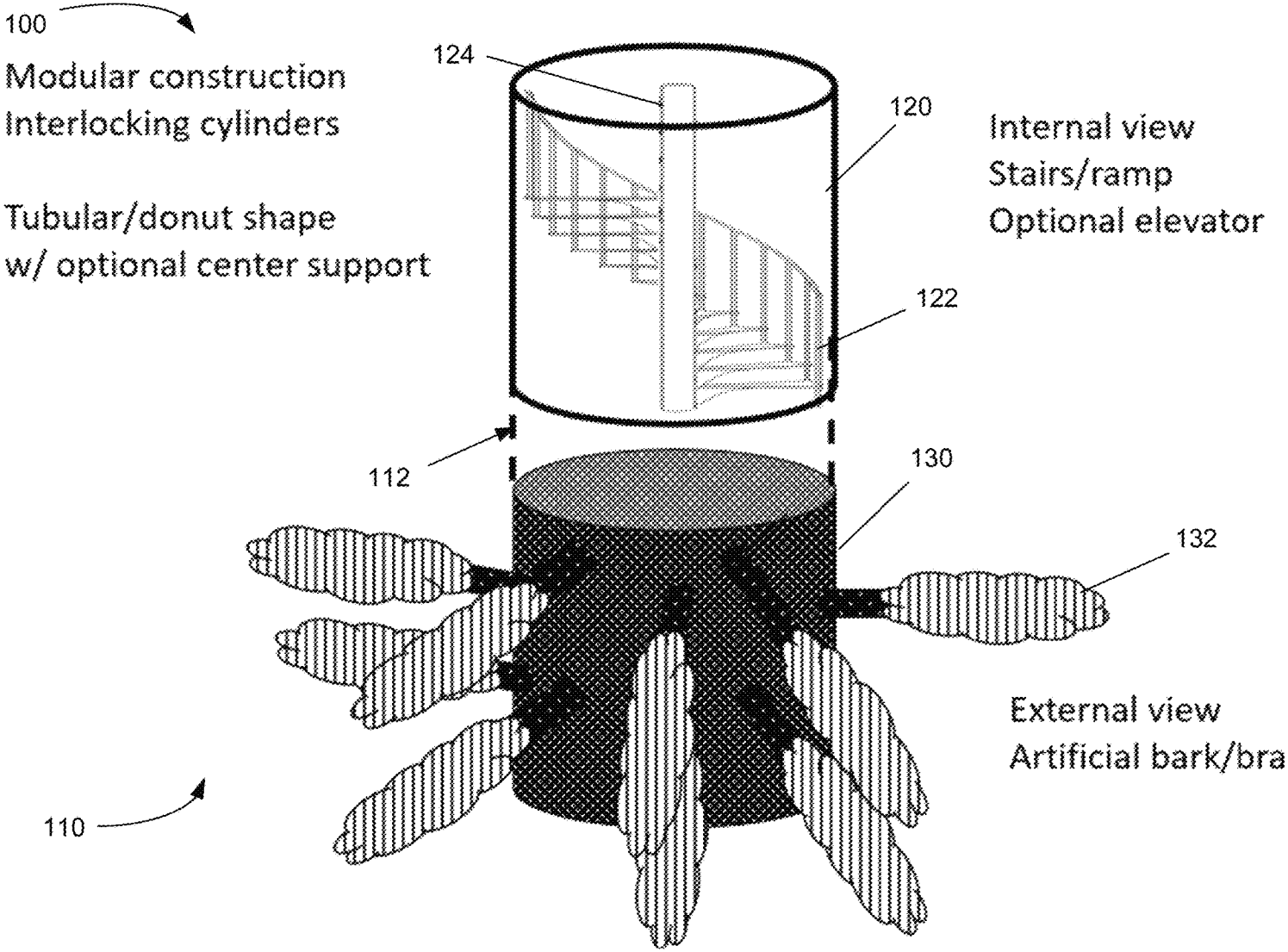
FIG. 1 schematically illustrates a section of a vertical escape structure showing an exterior and an interior thereof according to an embodiment of the invention.

FIG. 1 schematically illustrates a section of a vertical escape structure showing an exterior and an interior thereof according to an embodiment of the invention. The vertical escape structure 100 includes an escape housing 110 disposed in a vertical orientation and mounted or anchored to a ground to maintain structural integrity in the vertical orientation against external flooding or forces. In the housing section or module 112 as shown, the escape housing 110 includes an interior 120 which is sealed against water entry from the exterior flooding and to prevent flood waters from travelling up the interior of the escape housing 110.

At least one of a staircase 122, an elevator, or a lift may be disposed in the interior 120 of the escape housing 110. The escape housing 110 includes an exterior 130 which may be configured to blend in with the environment in which it is deployed. For example, the exterior 130 may resemble a trunk of a tree with artificial bark or branches 132.

The escape housing 110 may be tubular or donut shaped and may be designed with the appearance of a tree. A diameter or cross-sectional width of the central structure or housing 110 may vary to accommodate a type of egress (e.g., wider diameter for a ramp having a gentle slope, narrower diameter for a spiral staircase). In an embodiment, a core of the housing 110 resembles a trunk of a tree and includes artificial bark or branches 132 attached to an exterior 130 of the core of the housing 110. In this example, the interior 120 of the housing 110 includes an internal staircase 122. Other embodiments may include an elevator, a lift, a crank elevator platform, spiral ramp, ladder, or some other internal mechanism to allow people (including handicapped access) to ascend and/or descend while being sheltered and protected by the housing 110. A powered elevator may be used and may include a mechanical backup for power failures. One embodiment is based on a tubular steel tower with a spiral ramp or spiral staircase and includes a crank elevator to raise and lower a platform in the housing 110. The housing 110 may be made of fiberglass, steel, aluminum, concrete, or the like.

The escape housing 110 may be modular in construction, with interlocking, vertically stacked modules, allowing for customizable heights of the vertical escape structure 100 as needed for different flood zones. A module (e.g., 112) may have a cylindrical tube shape, box shape, donut shape, or other shape suitable for stacking together to form the housing 110. A module may include an optional center support or core structure (e.g., a post 124). A module may have solid walls or walls made of mesh or other materials to allow air and light to pass through. A module may include at least a portion for structural reinforcement, such as a passage or passages to accommodate beams/columns, tension cables, poured concrete, blocks or stones, sand or soil, and the like.

The escape housing 110 may be formed by stacking different types of modules. One type of module may contain a room or a portion of a room. Another type of module may contain a staircase or a portion of a staircase. The modules may be designed to interlock with each other and provide alignment between interlocked modules. For example, a room module may be stacked on top of and be interlock with a stairway module. The interlocked modules align such that a floor opening of the room module aligns with a top of a stairway of the underlying stairway module, to provide an uninterrupted passageway between the modules. The bottom of one stairway module may interface with the top opening of another stairway module to allow the stairways to align and form a continuous internal stairway (or ramp) spanning both modules. A stairway module may include a door or may be coupled to a door module that includes a door.

Figure 2:
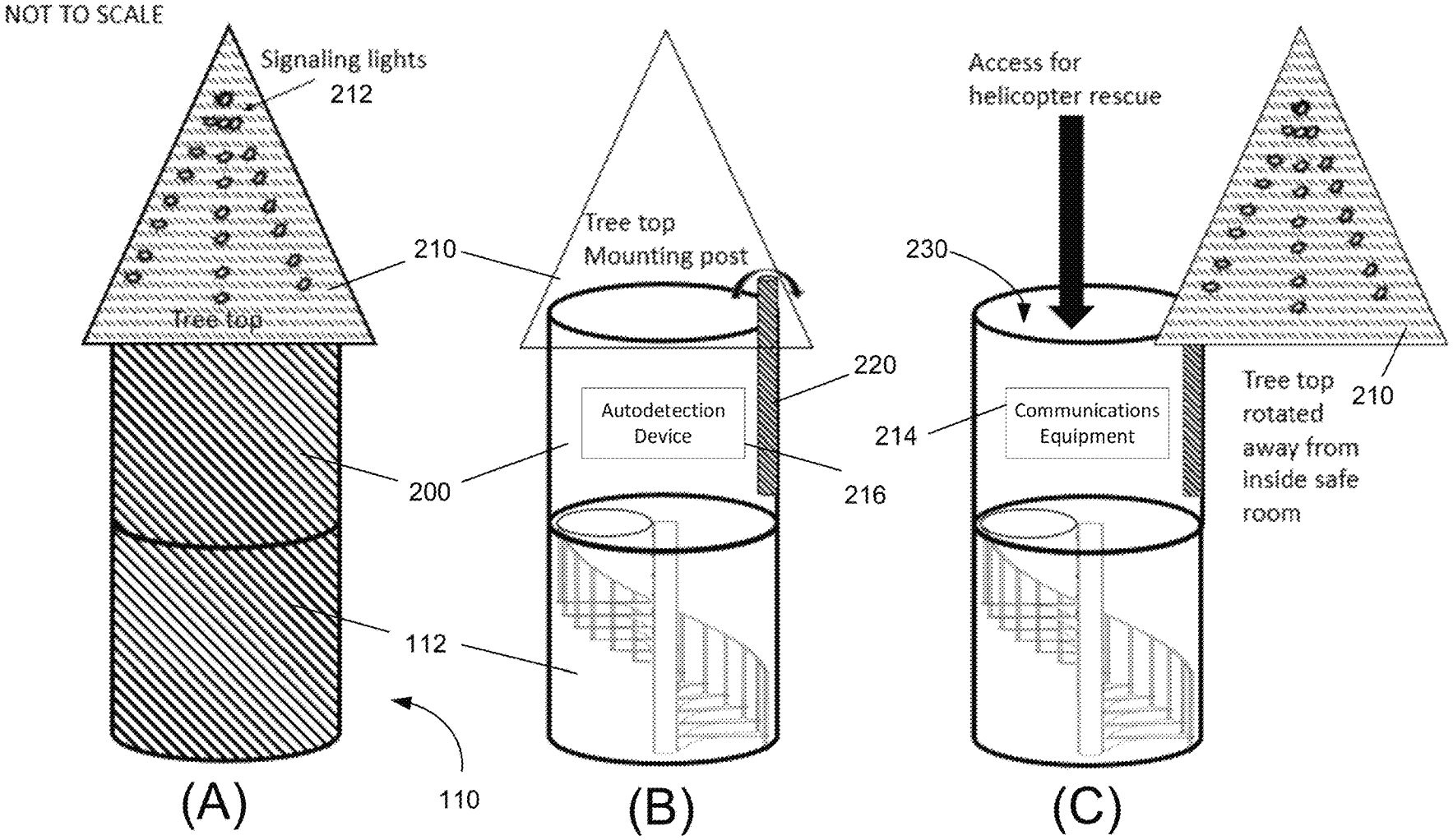
FIG. 2 schematically illustrates an example of an escape housing of the vertical escape structure including a top section and a roof showing (A) the roof in a closed position, (B) the roof being rotated around a mounting post, and (C) the roof having been rotated away to provide rescue access such as helicopter rescue access.

FIG. 2 schematically illustrates an example of an escape housing of the vertical escape structure including a top section and a roof showing (A) the roof in a closed position, (B) the roof being rotated around a mounting post, and (C) the roof having been rotated away to provide rescue access such as helicopter rescue access.

In this embodiment, the escape housing 110 includes a stair module 112 of FIG. 1 and a safe room module 200 stacked on top as the top module or section. The roof 210 may be conical in shape as shown or having another shape such as hemispherical or flat.

The escape housing 110 may include communications equipment 214 (which may be one way or bidirectional including, for example, emergency phone, cellular signal, tsunami warning sirens, etc.), battery backup as a source of power in case of power failure, and flashing beacon(s). The flashing beacons, such as signaling lights 212, may be arranged on the roof 210 to signal to rescuers (e.g., using drones or helicopters) that the escape housing 110 is occupied and may be in need of assistance. The equipment or beacons may be permanently incorporated into the escape housing 110 and may be activated automatically or manually by the occupants inside. The equipment or beacons may be automatically activated upon detection of the occupants (e.g., using sensors or other autodetection devices 216 to detect audio, visual, heat signature, vibration, etc.), and/or based on the detection of flood conditions. Alternatively, the equipment or beacons may be activated remotely, for example, by a command center that monitors occupant detectors of the structure and flood conditions at the site of the structure. In the embodiment show in FIG. 2(A), the beacons are signaling lights 212, arranged in a pattern on a conical roof 210 of the housing 110 having the appearance of a treetop. The signaling lights 212 may be disguised or concealed within the treetop appearance (e.g., dispersed among artificial leaves or branches). When turned on, the signaling lights 212 produce exterior light signals visible externally of the escape housing 110.

As seen in FIG. 2(B), the top module 200 includes a safe room and a roof 210 that can be actuated to provide an opening through the top of the top module 200 to provide rescue access (e.g., for helicopter rescue access). The retractable roof 210 may be actuated from inside the top module 200. At least a portion of the roof 210 may be actuated by rotating aside, retracting, lifting upward or off, pivoting, or the like from the interior of the housing 110 to provide access. The top module 200 as shown is a safe room module incorporating a room or room portion. Alternatively, the top module may be an additional module fitted on top of a room module.

In the example shown, a roof mounting post 220 provides a pivot attachment between the top module 200 and the conical roof 210. The occupants in the top module may rotate the conical roof 210 with the roof mounting post 220 relative to the housing 110. This allows the conical roof 210 to rotate aside to uncover a top of the top module or safe room module 200, providing access for rescue access such as helicopter rescue access to the occupants in the safe room module 200, as seen in FIG. 2(C). In an embodiment, the occupants actuate the retractable roof 210 from inside the safe room, to cause the roof 210 to rotate away, for example, using a handle or crank mechanically coupled to the roof mounting post 220. In another embodiment, the top module 200 includes an actuator on an exterior of the top module 200, which may be actuated by rescue personnel or others outside of the structure to rotate the roof 210. In another embodiment, the roof 210 that may be removed externally in some other way, for example, by rescue personnel.

When the top opens as seen in FIG. 2(C), a line can be dropped from a helicopter into the interior of the top module 200 to rescue the occupants inside. Alternatively, instead of an open top, retracting the roof 210 may expose a platform 230 or other form of egress suitable to conduct evacuation by landing a helicopter or the like. In another embodiment, the roof is flat and serves as a landing platform that can be accessed via a hatch. The roof platform need not be retractable. In yet another embodiment, the flat roof is rotatable away from the interior of the housing 110. A helicopter may land on the retracted roof platform and the occupants may reach the retracted roof platform via stairs, ladder, lift, or the like.

Figure 3:
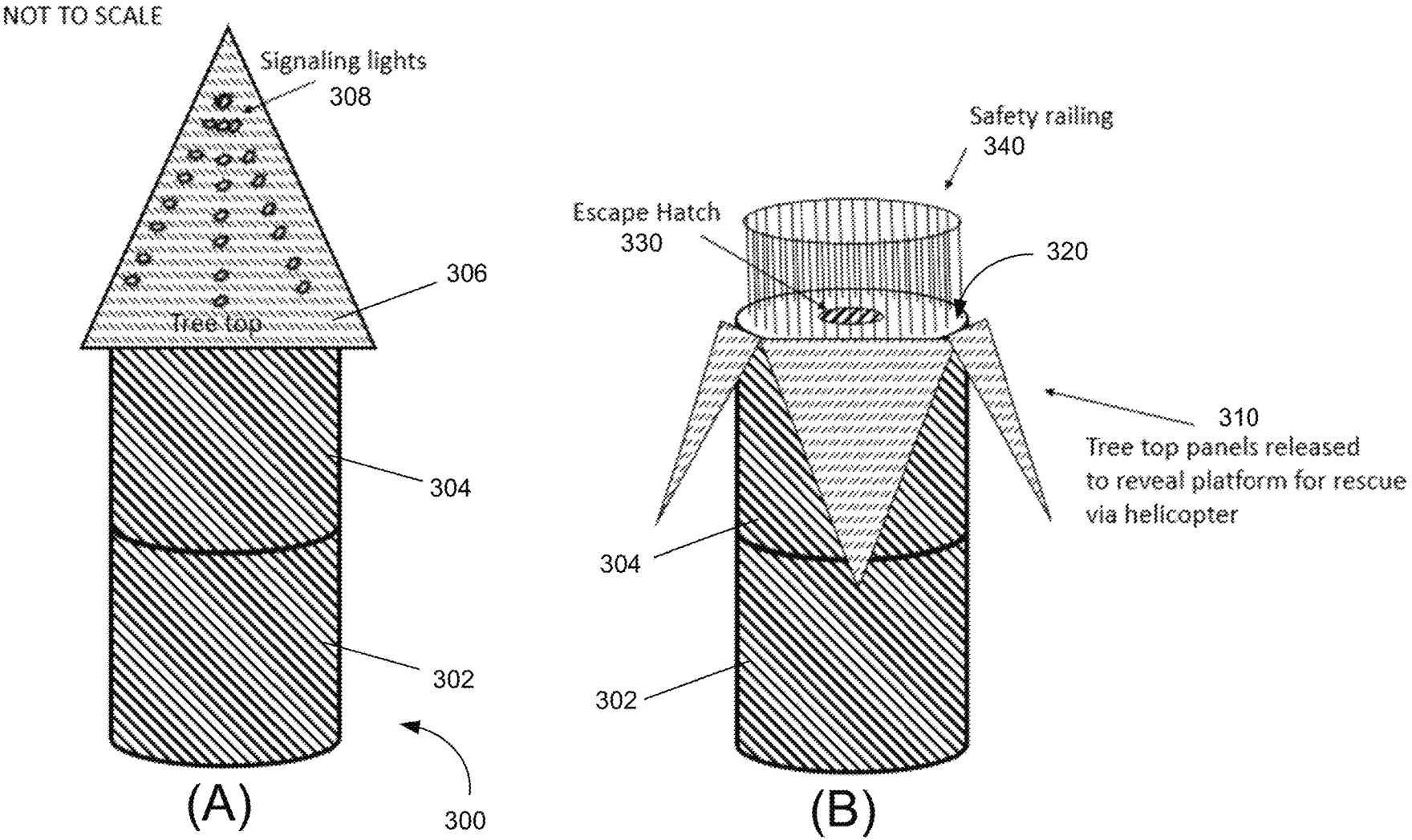
FIG. 3 schematically illustrates another example of a top section or top module of the escape housing of the vertical escape structure and a roof showing (A) the roof in a closed position and (B) the roof being unfolded away to provide rescue access such as helicopter rescue access.

FIG. 3 schematically illustrates another example of a top section or top module of the escape housing of the vertical escape structure and a roof showing (A) the roof in a closed position and (B) the roof being unfolded away to provide rescue access such as helicopter rescue access.

FIG. 3(A) shows the escape housing 300 which includes the stair module 302, the top module 304 having a safe room, and a retractable roof 306 having signaling lights 308. As seen in FIG. 3(B), another example of the retractive roof (conical or otherwise) is made of a plurality of panels or plates 310 of material (e.g., steel, wood, etc.) hingedly or rotatably attached at the bottom to the top module 304 to allow them to fold up toward each other at the center point at the top to form a cone-shaped roof 306 in a closed position and to fold down away from each other at the center point at the top to retract from the interior of the escape housing 300 in an open position. It allows a platform 320 to be exposed at the top of the exposed structure, allowing open access to helicopter/ladder rescue. In this example, an escape hatch 330 provides access to the platform 320 from the interior of the top module 304. The top module 304 may include safety railing 340 around the platform 320 to protect the occupants.

Figure 4:
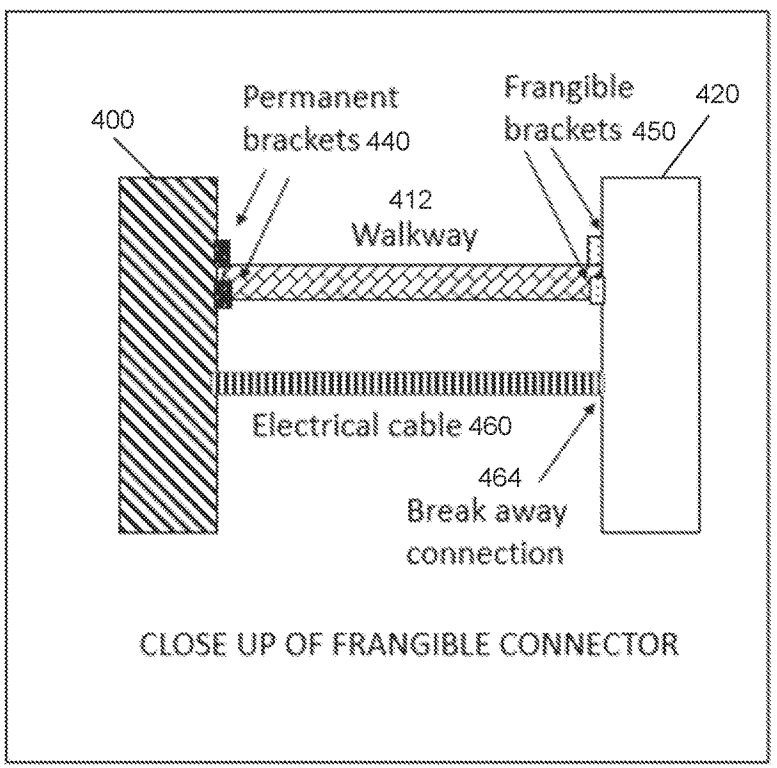
FIG. 4 shows (A) an exterior elevational view of a vertical escape structure including an example of a connecting walkway connecting an escape housing of the vertical escape structure to a main house or building and (B) a close-up view illustrating details of the connecting walkway.
Figure 4:
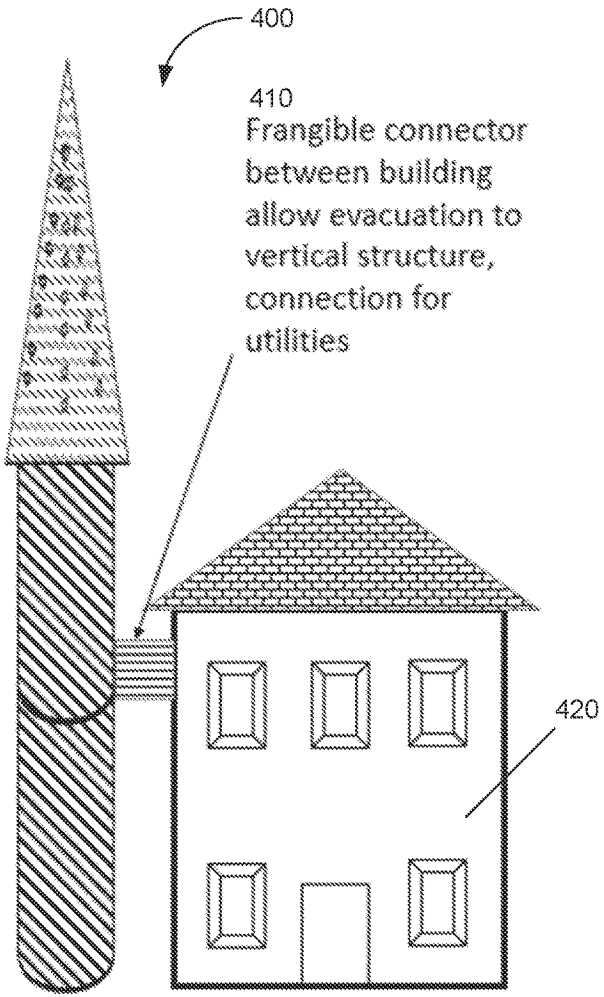

FIG. 4 shows (A) an exterior elevational view of a vertical escape structure including an example of a frangible connector 410 including an enclosed connecting walkway connecting an escape housing 400 of the vertical escape structure to a main house or building 420 and (B) a close-up view illustrating details of the connecting walkway 412 by removing the enclosure of the frangible connector 410. The escape housing 400 has a smaller horizontal footprint than the building 420. It may be a substantially smaller footprint. For example, the building 420 may be 2000 square feet and the escape housing 400 may be 200 square feet or less, which is an order of magnitude lower in horizontal footprint.

The enclosed connecting walkway 410 may be elevated above the ground to form a skyway. It may be an open or exposed walkway 412 or an enclosed walkway or skyway 410. In addition, the walkway 410 may be severable from the building 420 by force without damaging the escape housing 400 to cause water entry from the exterior flooding. For example, the connecting walkway 410 may be frangible as compared to the escape housing 400 by using a weaker material and/or a weaker structure for the connecting walkway 410 as compared to the escape housing 400.

In one embodiment, the enclosed connecting walkway 410 may be attached to the house or building 420 to provide bracing to the building 420 and allow evacuation directly from the building 420 (e.g., evacuation from an upper floor of the building directly into the escape housing 400). The walkway 410 may be an attachable structure configured to allow people to enter the escape housing 400 from the building 420. In an embodiment, the connecting walkway 410 is elevated by approximately the height of one story of the building 420 to which the walkway 410 is attached. It allows people to walk naturally from the building 420 through the connecting walkway 410 to the escape housing 400.

The elevated connector 410 between the escape housing 400 and an upper floor of the building 420 enables the escape housing 400 to have no need for ground level access (e.g., no ground level door or entry) because the elevated connector 410 provides access to the escape housing 400. The enclosed connecting walkway 410 has increased security and increased structural stability, based on its connection to the escape housing 400 and the building 420. Furthermore, such building-connected escape structures with elevated above-ground access can devote interior space, otherwise needed for passageways, for added structural support. For example, lower modules of the escape housing 400, disposed below the elevated walkway 410 at an upper floor of the building 420, may be reinforced with concrete, such as by filling a center of those modules with concrete. In one example, a bottom module may be converted into a structural foundation. In another example, one or more lower modules are filled with concrete and partially or fully buried below grade on site, ready to be interlocked with additional modules above to form the entire escape housing 400.

The enclosed connecting walkway 410 may include structural connections, electrical connections, and other connections to the building 420 that are frangible/severable to allow the escape housing 400 to stand and function as an escape structure even if the building 420 is swept away or otherwise collapsed/destroyed by flood waters. The connecting walkway 410 is configured to be weaker than the amount of force required to damage or deform the escape housing 400. It may be substantially weaker. For example, it may require a force that is an order of magnitude higher (i.e., 10 times higher or more) to damage the escape housing 400 than to disconnect the walkway 410 from the building 420. Bracing or other connections such as the physical walkway 410 between the escape housing 400 and the adjacent building 420 can be made of weaker materials or designed in such a way that will break under stress/strain.

In one example as shown in FIG. 4(B), the walkway 412 may be connected to the escape housing 400 using permanent brackets 440 and to the building 420 using frangible brackets 450 made of a weaker material and/or a weaker construction. The frangible brackets 450 break under a force that may be substantially lower (e.g., an order of magnitude lower) than the force required to break the permanent brackets 440 and the force required to break the connecting walkway 412 and the force required to damage the escape housing 400 to cause flood water leakage into the escape housing 400. In addition, other connections such as electrical connections may be frangible/severable to prevent the escape housing from failing in the event the building 420 is swept away by flood waters. FIG. 4(B) shows an electrical cable 460 connected to the building 420 using a breakaway connection 464. The electrical cable 460 is an example of utility connections that are severable. Another example is a potable water line. The above describes examples of a mechanism or means for connecting a walkway 412 between the escape housing 400 and a building 420 to render the walkway 412 severable from the building 420 by force without damaging the escape housing 400 to cause water entry from the external flooding.

Figure 5:
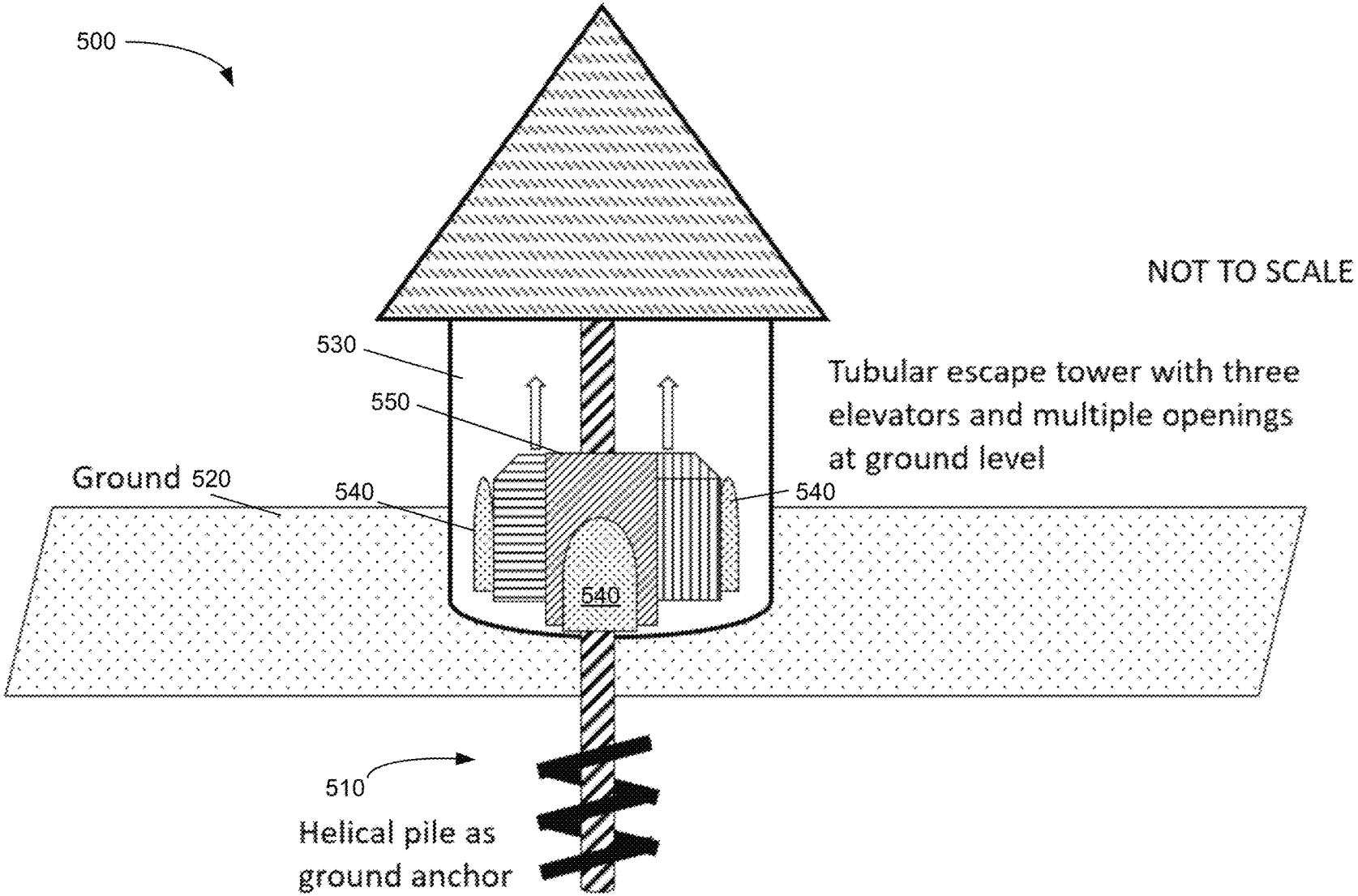
FIG. 5 is an elevational view of a vertical escape structure illustrating an example of a ground anchor for mounting or anchoring or securing the vertical escape structure to the ground.

FIG. 5 is an elevational view of a vertical escape structure 500 illustrating an example of a ground anchor 510 for mounting or anchoring or securing the vertical escape structure to the ground 520. One or more helical piles 510 may be used to mount or anchor the escape housing 530 to the ground.

The escape housing 530 may include at least one door 540 that is securable from the inside or the outside. The door 540 may be sealable to prevent water from passing or may be formed with an open mesh or the like to allow water to pass. The door 540 may be contained in a single module or may span multiple modules. In another embodiment, a door may be positioned to control access between modules of the escape housing 530. For example, a door in the floor of one module allows access to an underlying module. In another embodiment, a door may be positioned to control access from one or more modules to the outside of the escape housing 530 (e.g., a door in the wall of one or more modules). The door 540 may be designed to seal off some or all of the escape housing 530 from flood waters (e.g., preventing flood waters from traveling up an interior space of the escape housing 530). One or more elevators 550 may be provided inside the escape housing 530. The vertical escape structure 100 can be placed anywhere floods are anticipated. It is not limited to tsunami use only in coastal areas.

The inventive concepts taught by way of the examples discussed above are amenable to modification, rearrangement, and embodiment in several ways. For example, this invention may be applicable in other systems having different geometries, sizes, or arrangements of components. Accordingly, although the present disclosure has been described with reference to specific embodiments and examples, persons skilled in the art will recognize that changes may be made in form and detail without departing from the spirit and scope of the disclosure.

An interpretation under 35 U.S.C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not be taken as limiting or restricting the systems, techniques, approaches, methods, or devices to those appearing in any section. Rather, the teachings and disclosures herein can be combined or rearranged with other portions of this disclosure and the knowledge of one of ordinary skill in the art. It is intended that this disclosure encompass and include such variation.

The indication of any elements or steps as "optional" does not indicate that all other or any other elements or steps are mandatory. The claims define the invention and form part of the specification. Limitations from the written description are not to be read into the claims.

What is claimed is:

1. A vertical escape structure comprising:

an escape housing disposed in a vertical orientation and mounted to a ground to maintain structural integrity in the vertical orientation against external flooding, the escape housing including an interior which is sealed against water entry from exterior flooding and at least one of a staircase, a ladder, an elevator, or a lift disposed in the interior of the escape housing; and a connecting walkway to connect the escape housing to a building, the connecting walkway being severable from the building by force without damaging the escape housing to cause water entry from the exterior flooding.

2. The vertical escape structure of claim 1, wherein the connecting walkway is frangible as compared to the escape housing by using at least one of a weaker material or a weaker structure for the connecting walkway as compared to the escape housing.

3. The vertical escape structure of claim 1, wherein the connecting walkway is elevated above the ground to form a skyway.

4. The vertical escape structure of claim 1, wherein the connecting walkway is an enclosed walkway.

5. The vertical escape structure of claim 1, wherein the escape housing includes a retractable roof.

6. The vertical escape structure of claim 5, wherein the escape housing includes a platform for helicopter landing which is exposed by retracting the retractable roof.

7. The vertical escape structure of claim 5, wherein the escape housing includes a roof mounting post which is rotatable relative to the escape housing; and wherein the retractable roof is rotatable with the roof mounting post to retract from the interior of the escape housing.

8. The vertical escape structure of claim 1, further comprising:

one or more helical piles to mount the escape housing to the ground.

9. The vertical escape structure of claim 1, wherein the escape housing includes a plurality of vertically stacked modules.

10. The vertical escape structure of claim 1, further comprising:

signaling lights to produce exterior light signals visible externally of the escape housing.

11. A method of providing escape from flooding, the method comprising:

mounting an escape housing in a vertical orientation to a ground to maintain structural integrity in the vertical orientation against external flooding;

sealing an interior of the escape housing against water entry from exterior flooding;

providing at least one of a staircase, a ladder, an elevator, or a lift in the interior of the escape housing; and connecting a connecting walkway between the escape housing and a building, the escape housing having a smaller horizontal footprint than the building, the connecting walkway being severable from the building by force without damaging the escape housing to cause water entry from the external flooding.

12. The method of claim 11, further comprising:

configuring the connecting walkway to be frangible as compared to the escape housing by using at least one of a weaker material or a weaker structure for the connecting walkway as compared to the escape housing.

13. The method of claim 11, further comprising:

elevating the connecting walkway above the ground to form a skyway.

14. The method of claim 11, further comprising:

enclosing the connecting walkway to form an enclosed walkway.

15. The method of claim 11, further comprising:

retracting a retractable roof of the escape housing to facilitate rescue of occupants in the escape housing.

16. The method of claim 15, wherein retracting the retractable roof exposes a platform for helicopter landing.

17. The method of claim 15, further comprising:

mounting a roof mounting post to be rotatable relative to the escape housing;

wherein retracting the retractable roof comprising rotating the retractable roof with the roof mounting post to retract the retractable roof from the interior of the escape housing.

18. The method of claim 15, further comprising:

folding a plurality of panels toward each other to form the retractable roof in a closed position; and folding the plurality of panels away from each other to retract the retractable roof from the interior of the escape housing in an open position.

19. The method of claim 11, further comprising:

stacking a plurality of modules vertically to form the escape housing.

20. The method of claim 11, further comprising:

generating exterior light signals visible externally of the escape housing.

21. A vertical escape structure comprising:

an escape housing disposed in a vertical orientation and mounted to a ground to maintain structural integrity in the vertical orientation against external flooding, the escape housing including an interior which is sealed against water entry from exterior flooding and at least one of a staircase, a ladder, an elevator, or a lift disposed in the interior of the escape housing; and means for connecting a walkway between the escape housing and a building to render the walkway severable from the building by force without damaging the escape housing to cause water entry from the external flooding.

22. The vertical escape structure of claim 21, wherein the walkway is enclosed and elevated above the ground to form an enclosed skyway.

23. The vertical escape structure of claim 21, wherein the escape housing includes a retractable roof.

24. The vertical escape structure of claim 23, wherein the escape housing includes a roof mounting post which is mounted to the escape housing to be rotatable relative to the escape housing; and wherein the retractable roof is rotatable with the roof mounting post to retract from the interior of the escape housing.

25. The vertical escape structure of claim 24, wherein the escape housing includes a platform for helicopter landing which is exposed by retracting the retractable roof.

26. The vertical escape structure of claim 23, wherein the retractable roof includes a plurality of panels configured to fold up toward each other to form a cone-shaped roof in a closed position and to fold down away from each other to retract the retractable roof from the interior of the escape housing in an open position.

27. The vertical escape structure of claim 21, further comprising:

a severable utility connection to connect the escape housing to the building.

28. A vertical escape structure comprising:

a building;

an escape housing disposed in a vertical orientation and mounted to a ground to maintain structural integrity in the vertical orientation against external flooding, the escape housing including an interior which is sealed against water entry from exterior flooding and at least one of a staircase, a ladder, an elevator, or a lift disposed in the interior of the escape housing; and a connecting walkway to connect the escape housing to the building, the escape housing having a smaller horizontal footprint than the building, the connecting walkway being severable from the building by force without damaging the escape housing to cause water entry from the exterior flooding.

29. The vertical escape structure of claim 28, further comprising:

communications equipment in the escape housing.

30. The vertical escape structure of claim 28, further comprising:

an autodetection device in the escape housing.

* * * * *